US005626119A

United States Patent [19]

Timms

[11] Patent Number: 5,626,119

[45] Date of Patent: May 6, 1997

[54] FUEL SYSTEM

[75] Inventor: Colin T. Timms, Middlesex, Great Britain

[73] Assignee: Lucas Industries Public Limited Company, Solihull, United Kingdom

[21] Appl. No.: 619,248

[22] Filed: Mar. 21, 1996

[30] Foreign Application Priority Data

Apr. 4, 1995 [GB] United Kingdom ..... 9506959

[51] Int. Cl.[6] ..... F02M 37/04

[52] U.S. Cl. ..... 123/467; 123/506

[58] Field of Search ..... 123/467, 446, 123/447, 506

[56] References Cited

U.S. PATENT DOCUMENTS

| | | | |
|---|---|---|---|
| 4,249,497 | 2/1981 | Eheim | 123/467 |
| 4,750,462 | 6/1988 | Egler | 123/467 |
| 4,784,101 | 11/1988 | Iwanaga | 123/467 |
| 5,007,584 | 4/1991 | Rossignol | 239/88 |
| 5,012,786 | 5/1991 | Voss | 123/467 |
| 5,156,132 | 10/1992 | Iwanaga | 123/467 |
| 5,186,151 | 2/1993 | Schwerdt | 123/467 |
| 5,201,295 | 4/1993 | Kimberley | 123/467 |
| 5,265,804 | 11/1993 | Brunel | 123/506 |
| 5,522,364 | 6/1996 | Knight | 123/506 |

FOREIGN PATENT DOCUMENTS

| | | |
|---|---|---|
| 0269289 | 6/1988 | European Pat. Off. . |
| 0675282 | 10/1995 | European Pat. Off. . |
| 2105406 | 3/1983 | United Kingdom . |

*Primary Examiner*—Carl S. Miller

*Attorney, Agent, or Firm*—Jacobson, Price, Holman & Stern, PLLC

[57] ABSTRACT

A fuel system for an internal combustion engine comprises a plurality of pump/injectors each of which comprises a housing within which is provided a plunger-type fuel pump, a spill valve, an injector and a non-return valve. The pump is arranged to supply fuel at high pressure to the injector and to a port of the spill valve. The other port of the spill valve is connected to a source of fuel through a non-return valve, and also to the spring chamber of the injector through the non-return valve. The spring chamber communicates through a restrictor with a common passage the pressure within which is controlled by a valve.

8 Claims, 1 Drawing Sheet

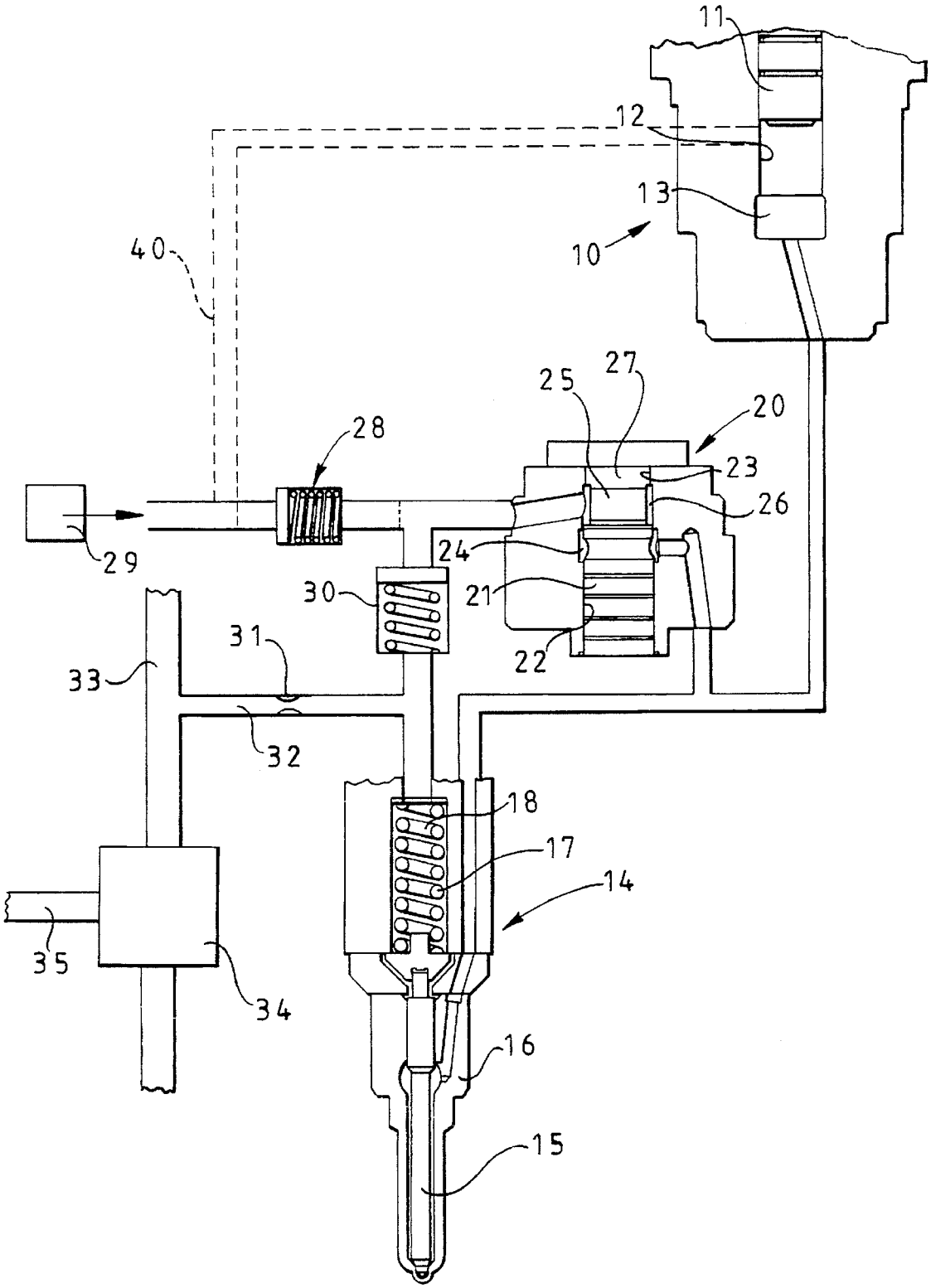
11
12
13
10
40
25
27
20
28
23
26
29
24
30
21
31
22
33
32
18
17
14
35
34
16
15

FUEL SYSTEM

This invention relates to a fuel injection system for an internal combustion engine and of the kind comprising a plurality of pump/injectors actuable by engine driven cams, the pump/injectors delivering fuel to the combustion chambers of the engine respectively, each pump/injector comprising a housing in which is defined a bore, a reciprocable plunger in the bore, the plunger being movable inwardly in the bore by a respective engine cam, the plunger and bore defining a pumping chamber from which fuel is expelled during inward movement of the plunger, a fuel injection nozzle mounted on the housing, the nozzle having an inwardly opening valve member which is biased by a spring to the closed position and is movable to the open position to allow fuel flow to the engine by fuel under pressure supplied from the pumping chamber, the spring being housed in a spring chamber the fuel pressure in which acts to assist the action of the spring, an electromagnetically operative spill valve having a pair of ports which are connected together when the spring valve is open, one of said ports communicating with the pumping chamber and the other of said ports communication with the spring chamber, and means restricting the flow of fuel from the spring chamber. A fuel inlet may communicate with said other of said ports of the spill valve through a non-return valve.

A pump/injector of the aforesaid type is shown in GB-A-2105406 in which the restricting means is in the form of a single restrictor in a passage leading from the spring chamber.

In a practical system incorporating a number of pump/injectors it is useful to be able to vary the fuel pressures in the spring chambers of the individual pump/injectors in order to after the so called nozzle opening pressures and the object of the present invention is to provide a system of the kind specified in which this can be achieved.

According to the invention in a system of the kind specified each pump/injector is provided with a non-return valve interposed between said other port of the spill valve and the spring chamber, the restricting means of each pump injector being interposed between the spring chamber and a common passage and valve means for controlling the pressure in said passage.

With reference to the drawing the pump/injector comprises a housing in which is defined a reciprocable plunger pump 10 which includes a pumping plunger 11 reciprocable in a bore 12 which with the plunger, defines a pump working chamber 13. The housing supports a fuel injection nozzle 14 having a valve member 15 movable by fuel pressure away from a seating defined in a nozzle body 16 by means of fuel under pressure acting on an annular area of the valve member. The valve member is biased into engagement with the seating by means of a spring 17 which is located in a spring chamber 18 and when the valve member has been lifted from the seating fuel can flow from the pump working chamber 13 through an outlet orifice or orifices formed in a nozzle tip.

The pump/injector also includes a spill valve 20 which incorporates a spill valve member 21 movable axially within a bore 22. The bore 22 has a narrower portion 23 and at the junction of the bores there is defined an annular seating surface engagable by the spill valve member when an associated solenoid is energised. In the wider portion of the bore adjacent the seating surface there is formed a groove and this with a reduced diameter portion of the valve member forms a valve inlet chamber 24 which communicates with the pump working chamber 13. The narrower portion 23 of the bore is also provided with a groove and the valve member with a reduced extension 25 so as to form a valve outlet chamber 26. At the end of the extension remote from the main portion of the valve member is a piston like member 27 which is a sliding fit within the narrower portion 23 of the bore.

The valve outlet chamber 26 communicates by way of a lightly loaded plate valve 28 with a source 29 of fuel under pressure, the plate valve being such as to permit flow of fuel towards the spill valve 20.

The outlet chamber 26 of the spill valve is also connected to the spring chamber 18 of the fuel injection nozzle 14 by way of a non-return valve 30 and in a branch passage 32 to the spring chamber is a restrictor 31. The valve 30 is arranged to allow flow of fuel towards the spring chamber.

The spill valve member 21 is biased by a spring to the open position and is movable to the closed position in which it is shown, upon energising a solenoid in a valve actuator forming part of the valve. In operation, during inward movement of the pumping plunger 11 under the action of an engine driven cam, fuel is expelled from the pump working chamber 13 and if the spill valve 20 is open, flows by way of the valve 30 through the restrictor 31. The pressure of the fuel is determined by the restrictor 31 and this pressure is applied to the valve member 15 of the fuel injection nozzle and assists the action of the spring 17 to keep the valve member in the closed position.

In order to obtain delivery of fuel to the engine, the solenoid associated with the spill valve 20 is energised and the valve member 21 is moved into engagement with the seating to prevent spillage of fuel. The pressure of the fuel which is applied to the annular area of the valve member 15 of the fuel injection nozzle is rapidly increased and when the pressure attains a high enough value the valve member is lifted from the seating to allow fuel flow to the engine. Such flow of fuel continues until the solenoid is again de-energised to allow the valve member 21 to lift from the seating. Apart from the fact that the fuel under pressure acting on the valve member of the fuel injection nozzle to maintain it in the open position is reduced rapidly when the valve member 21 lifts from its seating, the pressure wave which occurs as the spill valve 20 is opened, passes into the spring chamber 18 of the fuel injection nozzle and acts upon the valve member 15 to assist the movement of the valve member to the closed position.

When the pumping plunger 11 is allowed to move outwardly by the engine cam it does so under the action of a spring and fuel can then flow to the pump working chamber from the source 29 by way of the valve 28 and the open spill valve 20. The pump working chamber is completely filled with fuel prior to the next delivery of fuel.

As described the pressure wave which passes into the spring chamber will be dissipated through the restrictor 31 and the pressure in the spring chamber will assume the pressure which exists downstream of the restrictor.

In order to control the pressure within the spring chambers of the pump/injectors forming the engine fuel system the passage 32 which contains the restrictor of each pump/injector is connected to a common passage 33 and the pressure in this passage is controlled by a valve 34 which may be electromagnetically operable. The valve 34 opens to allow the surplus spilled fuel to flow through an outlet 35 to drain but it maintains a predetermined pressure within the passage 33 and hence in the spring chambers of the individual pump/injectors. The valves 30 trap the pressures within the respective spring chambers when the associated spill valves are open and the pumping plungers 11 are being moved outwardly.

In a modification to the device described hereinbefore, fuel is supplied from the source 29 directly to the bore 12 through a path 40 shown in dashed lines in the drawing rather than through the spill valve 20. In this modification the plate valve 28 may be omitted and the spill valve outlet chamber 27 communicates with the non-return valve 30. Such a modification simplifies the design.

I claim:

1. A fuel injection system for an internal combustion engine comprising a plurality of pump/injectors actuable by engine driven cams, the pump/injectors delivering fuel to the combustion chambers of the engine respectively, each pump/injector comprising a housing in which is defined a bore, a reciprocable plunger in the bore, the plunger being movable inwardly in the bore by a respective engine cam, the plunger and bore defining a pumping chamber from which fuel is expelled during inward movement of the plunger, a fuel injection nozzle mounted on the housing, the nozzle having an inwardly opening valve member which is biased by a spring to a closed position and is movable to an open position to allow fuel flow to the engine by fuel under pressure supplied from the pumping chamber, the spring being housed in a spring chamber the fuel pressure in which acts to assist the action of the spring, an electromagnetically operable spill valve having a pair of ports which are connected together when the spill valve is open, one of said ports communicating with the pumping chamber and the other of said ports communicating with the spring chamber, means restricting the flow of fuel from the spring chamber, and a first non-return valve interposed between said other port of the spill valve and the spring chamber, the restricting means of each pump injector being interposed between the spring chamber and a common passage and pressure control valve means for controlling the pressure in said common passage.

2. A system as claimed in claim 1, further comprising a fuel inlet arranged to communicate through a second non-return valve with said other of said ports of the spill valve.

3. A system as claimed in claim 2, wherein the second non-return valve of each pump/injector comprises a lightly loaded plate valve.

4. A system as claimed in claim 1, further comprising a fuel inlet arranged to communicate with the pumping chamber.

5. A system as claimed in claim 1, wherein the first non-return valve of each pump/injector is orientated so as to permit fuel flow from the spill valve to the spring chamber, and to restrict fuel flow from the spring chamber to the spill valve.

6. A system as claimed in claim 1, wherein the pressure control valve means comprises an electromagnetically operable valve.

7. A pump/injector comprising a housing in which is defined a bore, a reciprocable plunger in the bore, the plunger being movable inwardly in the bore by a respective engine cam, the plunger and bore defining a pumping chamber from which fuel is expelled during inward movement of the plunger, a fuel injection nozzle mounted on the housing, the nozzle having an inwardly opening valve member which is biased by a spring to a closed position and is movable to an open position to allow fuel flow to the engine by fuel under pressure supplied from the pumping chamber, the spring being housed in a spring chamber the fuel pressure in which acts to assist the action of the spring, an electromagnetically operable spill valve having a pair of ports which are connected together when the spill valve is open, one of said ports communicating with the pumping chamber and the other of said ports communicating with the spring chamber, means restricting the flow of fuel from the spring chamber, and a first non-return valve interposed between said other port of the spill valve and the spring chamber.

8. A pump/injector as claimed in claim 7, further comprising a fuel inlet arranged to communicate through a second non-return valve with the spring chamber.

* * * * *